US012629584B2

(12) United States Patent
Berthold

(10) Patent No.: US 12,629,584 B2
(45) Date of Patent: May 19, 2026

(54) STRATEGIC SPACE RACING BOARD GAME

(71) Applicant: David Berthold, East Hartford, CT (US)

(72) Inventor: David Berthold, East Hartford, CT (US)

( * ) Notice: Subject to any disclaimer, the term of this patent is extended or adjusted under 35 U.S.C. 154(b) by 312 days.

(21) Appl. No.: 18/625,577

(22) Filed: Apr. 3, 2024

(65) Prior Publication Data

US 2025/0018276 A1 Jan. 16, 2025

Related U.S. Application Data

(60) Provisional application No. 63/526,695, filed on Jul. 14, 2023.

(51) Int. Cl.

| | |
|---|---|
| ***A63F 3/00*** | (2006.01) |
| ***A63F 1/04*** | (2006.01) |
| ***A63F 11/00*** | (2006.01) |

(52) U.S. Cl.

CPC ..... *A63F 3/00091* (2013.01); *A63F 1/04* (2013.01); *A63F 3/0023* (2013.01); *A63F 11/0011* (2013.01); *A63F 2001/0483* (2013.01); *A63F 2003/00233* (2013.01); *A63F 2011/0016* (2013.01)

(58) Field of Classification Search

CPC ..... A63F 3/00091; A63F 1/04; A63F 2011/0016; A63F 2011/0018

USPC ..... 273/250, 251, 253

See application file for complete search history.

(56) References Cited

U.S. PATENT DOCUMENTS 1,311,810 A * 7/1919 Gilmore ..... A63F 3/00006 273/249
1,538,134 A * 5/1925 Muir ..... A63F 3/00091 273/250
1,567,975 A * 12/1925 Muir ..... A63F 3/00091 273/250
2,252,700 A * 8/1941 Clarke ..... A63F 3/0457 273/251
2,320,832 A * 6/1943 Schoenberg ..... A63F 3/0415 273/272
2,681,804 A * 6/1954 Stover ..... A63F 3/0423 273/272
2,990,181 A * 6/1961 Lippold ..... A63F 3/00091 273/287
3,223,420 A * 12/1965 Turner ..... A63F 3/00091 273/148 A
3,235,260 A * 2/1966 Glass ..... A63F 5/04 273/271

(Continued)

FOREIGN PATENT DOCUMENTS

GB 2076297 A * 12/1981 ..... A63F 3/00091
GB 2186198 A * 8/1987 ..... A63F 3/00091

(Continued)

*Primary Examiner* — Morgan T Jordan

(74) *Attorney, Agent, or Firm* — Ashley D. Johnson; Dogwood Patent and Trademark Law

(57) ABSTRACT

The invention is a board game in which players are in control of 2 supercharged "Astro Racers" that are ready for blast-off in a mad dash around the Solar System. Players collect power-ups while trying to avoid hazardous meteors, aliens and worm holes that can teleport them around a playing board. The first player to get both of their Astro Racers back to Earth wins the game.

8 Claims, 10 Drawing Sheets

(56) References Cited

U.S. PATENT DOCUMENTS 3,643,958 A * 2/1972 Sperber ..... A63F 3/00138 273/257
3,973,775 A * 8/1976 Bolan ..... A63F 3/00075 273/253
3,985,361 A * 10/1976 Millen ..... A63F 3/00091 273/250
4,111,427 A * 9/1978 Patterson ..... A63F 3/00091 273/250
4,114,891 A * 9/1978 Lawrimore ..... A63F 3/00091 273/250
4,247,113 A * 1/1981 La Capra ..... A63F 3/00091 273/250
4,545,582 A * 10/1985 Andrews ..... A63F 3/00643 273/249
4,575,095 A * 3/1986 Gaster ..... A63F 3/00075 273/143 R
4,804,190 A * 2/1989 Hofmann ..... A63F 3/00091 273/250
4,878,675 A * 11/1989 Perry ..... A63F 3/00006 273/269
4,907,808 A * 3/1990 Turner ..... A63F 3/00006 273/276
4,930,789 A * 6/1990 Harris ..... A63F 3/00157 273/274
5,071,132 A * 12/1991 Ward ..... G09B 23/26 273/276
5,282,630 A * 2/1994 Dupuis, Jr. ..... A63F 3/00082 273/252
5,306,007 A * 4/1994 Scuteri ..... A63F 9/181 273/161
5,318,304 A * 6/1994 Reppas ..... A63F 3/00028 273/244
5,342,059 A * 8/1994 Briem ..... A63F 3/00059 273/277
5,505,456 A * 4/1996 Schmidt ..... A63F 3/0423 434/167
5,687,969 A * 11/1997 Logan ..... A63F 3/00075 273/255
5,743,531 A * 4/1998 Rosa ..... A63F 3/00063 273/278
5,810,358 A * 9/1998 Manson ..... A63F 3/0494 273/251
6,065,750 A * 5/2000 Mattoon ..... A63F 3/00097 273/287
6,488,283 B1 * 12/2002 Grundy ..... A63F 3/00091 273/250
6,543,771 B1 * 4/2003 Kirckof ..... A63F 3/00006 273/258
7,182,342 B1 * 2/2007 Fulton, Jr. ..... A63F 3/0415 273/272
7,374,171 B1 * 5/2008 Mencarelli ..... A63F 1/04 273/262
7,828,293 B1 * 11/2010 Pruzan ..... A63F 9/0076 273/457
9,095,768 B1 * 8/2015 Bohadi ..... A63F 3/00145
11,198,054 B1 * 12/2021 Holtey ..... A63F 3/00176
2004/0080108 A1 * 4/2004 Huley ..... A63F 3/00028 273/243
2005/0184460 A1 * 8/2005 Hockenbrocht ..... A63F 3/0434 273/242
2007/0007726 A1 * 1/2007 Alessio ..... A63F 3/00006 273/242
2007/0045953 A1 * 3/2007 Alleyne ..... A63F 3/00072 273/243
2007/0063435 A1 * 3/2007 Tippy ..... A63F 3/00 273/243
2007/0158905 A1 * 7/2007 Fass ..... A63F 3/00 273/243
2008/0179829 A1 * 7/2008 Randle ..... A63F 3/00072 273/256
2009/0275003 A1 * 11/2009 Green ..... A63F 3/0478 434/129
2011/0248445 A1 * 10/2011 Kagen ..... A63F 3/00006 273/153 R
2012/0256374 A1 * 10/2012 Bowling ..... A63F 3/00006 273/242
2016/0001171 A1 * 1/2016 Burrow ..... A63F 3/00261 463/22
2016/0303468 A1 * 10/2016 Foster ..... A63F 3/0415
2017/0304713 A1 * 10/2017 Cloutier ..... A63F 3/00091
2020/0306617 A1 * 10/2020 Patil ..... A63F 3/00006
2023/0405451 A1 * 12/2023 Cornwall ..... G09B 1/02
2023/0415027 A1 * 12/2023 Peterson ..... A63F 3/0421
2025/0018276 A1 * 1/2025 Berthold ..... A63F 11/0011
2025/0352887 A1 * 11/2025 Berthold ..... A63F 3/00006

FOREIGN PATENT DOCUMENTS

GB 2470718 A * 12/2010 ..... A63F 9/0468
WO WO-2024076359 A1 * 4/2024 ..... A63F 1/04

* cited by examiner

16

STRATEGIC SPACE RACING BOARD GAME

CROSS REFERENCE TO RELATED APPLICATIONS

This application claims priority to U.S. Provisional Patent Application No. 63/526,695, filed Jul. 14, 2023, the entire content of which is hereby incorporated by reference.

TECHNICAL FIELD

The presently disclosed subject matter relates to a strategic board game that includes a space theme in which players control intergalactic racers that interact with a playing board to provide entertainment and learning skills to players.

BACKGROUND

Board games have been routinely played throughout the United States for many years. To this end, strategic board games (particularly space-themed board games) are known in the art, and many have proven entertaining to play. Much of the enjoyment of the games is derived from a sense of competition and overcoming obstacles, and that a superior strategy can translate into a faster player winning the game. For many, the enjoyment of one game over another corresponds to the extent that the layout of the board and the movement of the pieces simulate real space traveling conditions. In modern times, games such as Monopoly® have been consistently popular over a long period of time. In Monopoly® and other conventional games, playing pieces are moved around a game board using dice and cards in an effort to amass the most money and win the game. However, the noted prior art games typically take hours to win because players attempt to erect structures on captured property using earned money. Due to the long playing periods and monotony of prior art games, it would be beneficial to provide a space themed board game that offers a unique method of play. As such, the more realistic and exciting a board game, the enjoyment level of play will be greater. It would therefore be beneficial to provide a new board game for players that increases entertainment during play as well as promotes strategy learning.

SUMMARY

The presently disclosed subject matter is directed to a new, unique, and entertaining board game.

In some embodiments, the presently disclosed subject matter is directed to a game for one or more players. Particularly, the game comprises a playing board with a top playing surface defined by a single track, each track including a plurality of standard spaces, a plurality of planet spaces, and a start and end space. Each standard space can include a plurality of alien spaces and a plurality of card-drawing spaces. The game also includes a plurality of game pieces, two of each type. The game further includes a spinner and two dice. The game includes a plurality of cards, each indicating an action for a player in possession of the card, the actions selected from moving forwards a set number of spaces, moving backwards a set number of spaces, moving to a specific numbered space after using the spinner, switching playing piece location with another player playing piece location, moving a playing piece to the nearest planet space either forwards or backwards, moving an opponent's playing piece backwards to the nearest planet space.

In some embodiments, the start and end space is indicated by an image of planet Earth.

In some embodiments, the playing board is square or rectangular in shape.

In some embodiments, the playing board is foldable about a central crease.

In some embodiments, the playing board includes at least one slit configured to accommodate the spinner.

In some embodiments, the spinner includes a rotatable arrow positioned on a top face of the playing board and a base positioned adjacent to a bottom face of the playing board, wherein the spinner passes through a thickness of the board.

In some embodiments, the top face of the playing board includes numbers positioned about the arrow.

In some embodiments, a plurality of the spaces includes space-themed imagery selected from orbits, planets, black holes, aliens, spaceships, or combinations thereof.

In some embodiments, a plurality of the spaces include numbers in combination with the one or more space-themed images.

In some embodiments, the start space and end space are the same space.

In some embodiments, the presently disclosed subject matter is directed to a method of playing the disclosed game. Specifically, the method comprises assigning two game pieces to each player, positioning all game pieces on the start space, and determining playing order of each player. A first player rolls the dice and advances a first playing piece the number assigned to one die and a second playing piece a number assigned to the second die rolled. If a player's move would cause them to land on a standard space occupied by a number of playing pieces equal to the number of players, that player loses that move and does not advance to the space occupied by the other playing pieces. After the first player rolls the dice, moves the playing pieces and takes appropriate action, the first player's turn is over and play moves to the next player. The first player to return both playing pieces to the end space is determined the winner of the game.

In some embodiments, playing order is determined by spinning the spinner, such that the player that spins the higher number is the first player to move.

In some embodiments, if a player rolls the same number on both dice, that player must roll again.

In some embodiments, if a player rolls doubles twice in a row, the player loses a turn.

In some embodiments, a player must roll exactly the number of spaces to land in the end space.

In some embodiments, when a playing piece lands on an alien space, the player spins the spinner and moves backward to the nearest planet space if the number on the spinner matches a number on the alien space.

In some embodiments, when a player lands on a drawing card space, that player draws a card that directs the player to take an action.

In some embodiments, the action is selected from moving forwards a set number of spaces, moving backwards a set number of spaces, moving to a specific numbered space after using the spinner, switching playing piece location with another player playing piece location, moving a playing piece to the nearest planet space either forwards or backwards, moving an opponent's playing piece backwards to the nearest planet space.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

Figure 1:
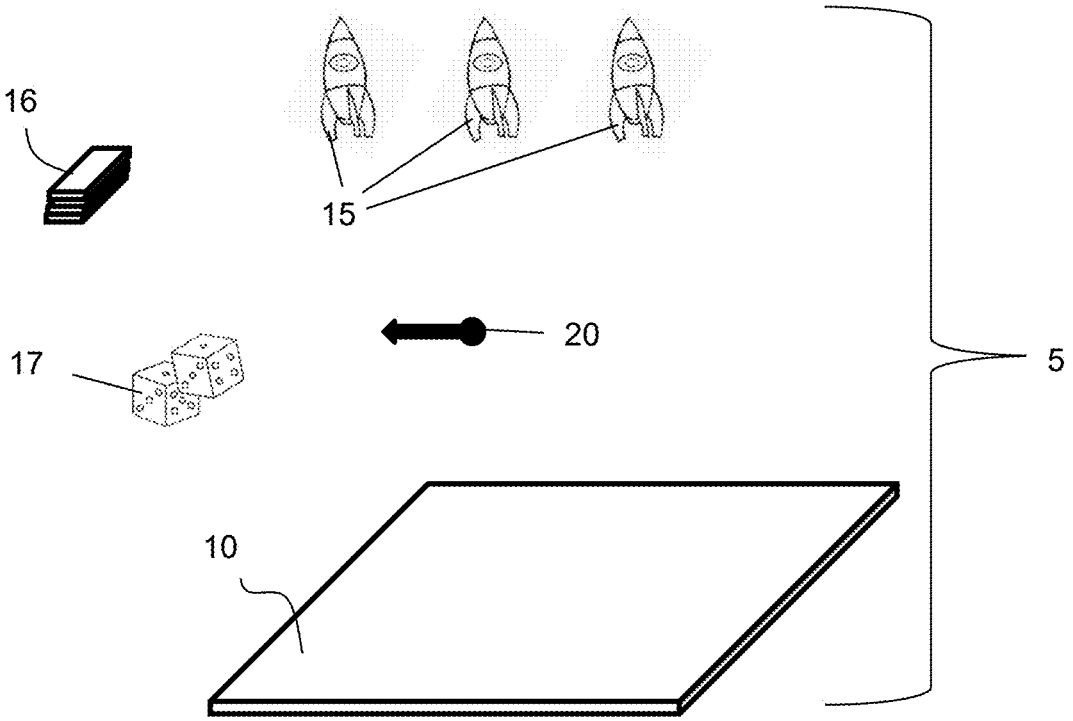
FIG. 1 is a schematic of a board game in accordance with some embodiments of the presently disclosed subject matter.

The presently disclosed subject matter is directed to a unique board game and associated method for playing a board game. The term "board game" as used herein broadly refers to a game played according to a set of rules where players participate in game competition using a playing board. As shown in FIG. 1, board game 5 includes playing board 10, one or more playing pieces 15, a set of cards 16, dice 17, and spinner 20. Specifically, the board game includes one or more (e.g., two) playing pieces (termed "astro racers") per player that travel around solar system game board 10 and collect power-ups, while trying to avoid various hazards (e.g., meteors, aliens, worm holes). The goal of game 5 is to be the first player to get all of that player's playing pieces back to Earth to win the game.

Figure 2A:
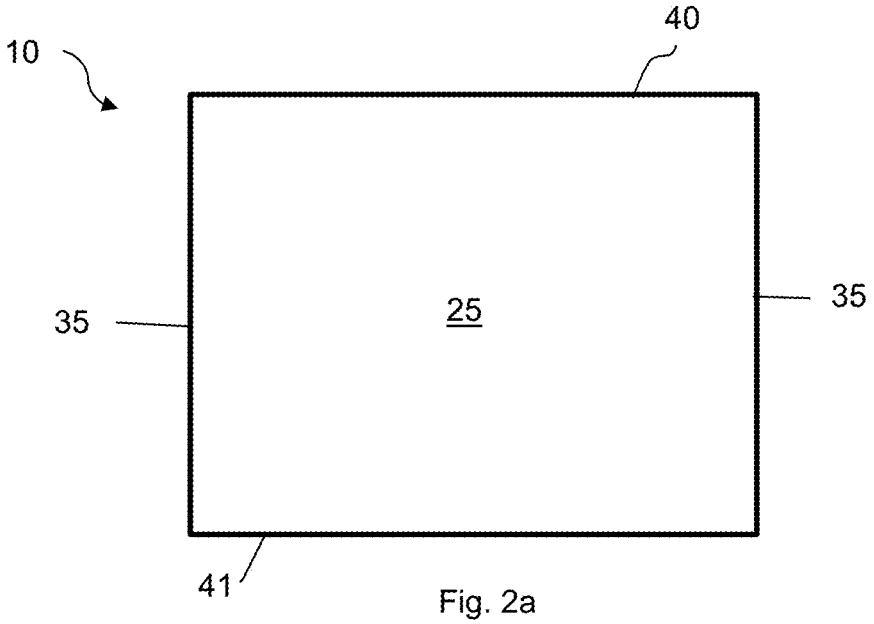
FIG. 2*a* is a top plan view of a playing board in accordance with some embodiments of the presently disclosed subject matter.
Figure 2B:
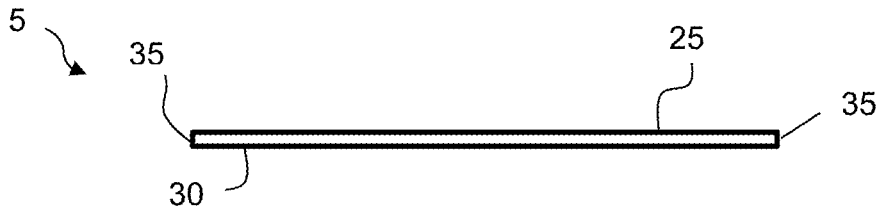
FIG. 2*b* is a front plan view of a playing board in accordance with some embodiments of the presently disclosed subject matter.

As noted above, game 5 includes playing board 10 that provides a surface upon which to play the game. FIGS. 2*a* and 2*b* illustrate one embodiment of playing board 10 comprising top playing surface 25 and opposed bottom surface 30. Players interact with the top playing surface, such as by moving game pieces 15 along a pathway as described in detail below. The bottom surface of the playing board rests upon and directly contacts a support surface, such as a table, the floor, etc. The playing board also can include a pair of side edges 35 and opposed top and bottom edges 40, 41.

Playing board 10 can be constructed from any suitable materials, such as (but not limited to) cardboard, plastic, metal, wood, or combinations thereof. Top playing surface 25 can be printed or otherwise include graphical representations, such as numbers, images, words, and the like. The top playing surface can be printed on the playing board using a printing process, adhered to the playing board, or may be formed as a part of the playing board itself.

Figure 3A:
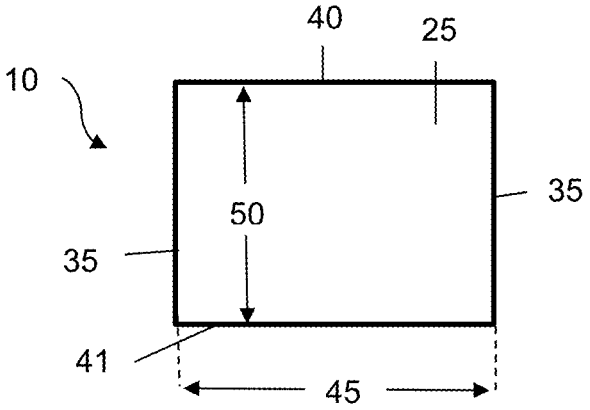
FIG. 3*a* is a top plan view of a playing board in accordance with some embodiments of the presently disclosed subject matter.

The playing board is not limited and can be configured in any desired size. For example, the playing board can be configured with length 45 and width 50 as shown in FIG. 3*a*. The term "length" refers to the longest straight-line horizontal distance of the game board (e.g., between opposed side edges 35 in some embodiments). The term "width" refers to the longest straight-line vertical distance of the game board (e.g., between the upper and lower edges 40, 41 in some embodiments). For example, the game board can include length 45 and/or width 50 of about 5-50 inches (e.g., at least/no more than about 5, 10, 15, 20, 25, 30, 35, 40, 45, or 50 inches). It should be appreciated that the dimensions of the playing board are not limited and can be configured larger or smaller than the length and width ranges given above.

Figure 3B:
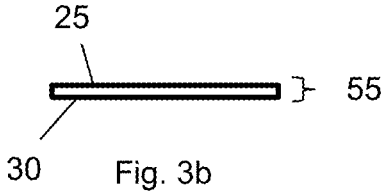
FIG. 3*b* is a front plan view of a playing board in accordance with some embodiments of the presently disclosed subject matter.
Figure 4A:
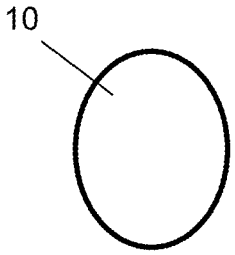
FIGS. 4*a*-4*f* are top plan views of playing boards in accordance with some embodiments of the presently disclosed subject matter.
Figure 4B:
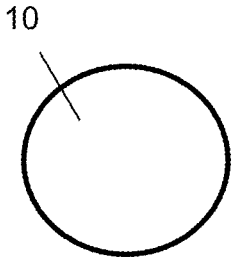
Figure 4C:
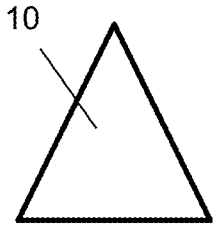
Figure 4D:
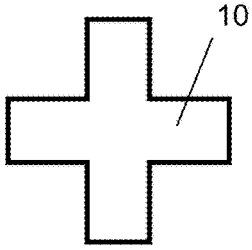
Figure 4E:
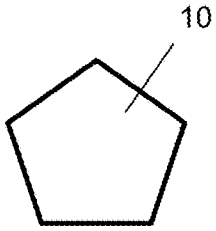
Figure 4F:
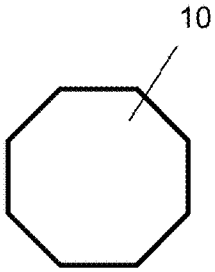

The playing board can also include thickness 55 as shown in FIG. 3*b*. The term "thickness" refers to the distance between the board top and bottom surfaces 25, 30, as shown in FIG. 3*b*. Playing board 10 can have thickness 55 of about 0.1-1 inches in some embodiments. However, the presently disclosed subject matter is not limited and the playing board thickness can be greater or less than the given range.

Although depicted as square or rectangular in shape in the Figures, the playing board can have any suitable shape, such as (but not limited to) oval, round, triangular, cross-shaped, pentagonal, octagonal, and the like, as shown in FIGS. 4*a*-4*f*, respectively. It should be noted that any shaped playing board can be used.

Figure 5A:
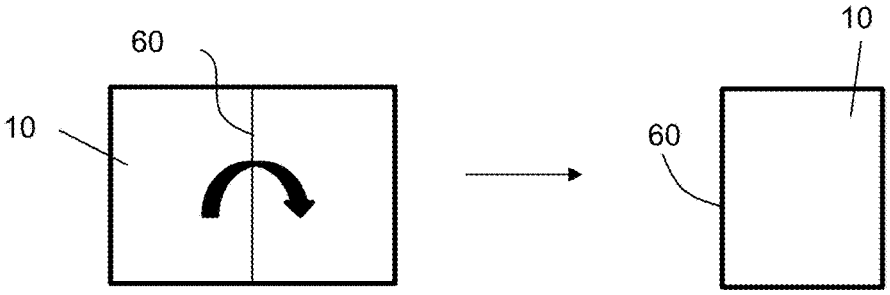
FIGS. 5*a* and 5*b* are top plan views of folding a playing board in accordance with some embodiments of the presently disclosed subject matter.
Figure 5B:
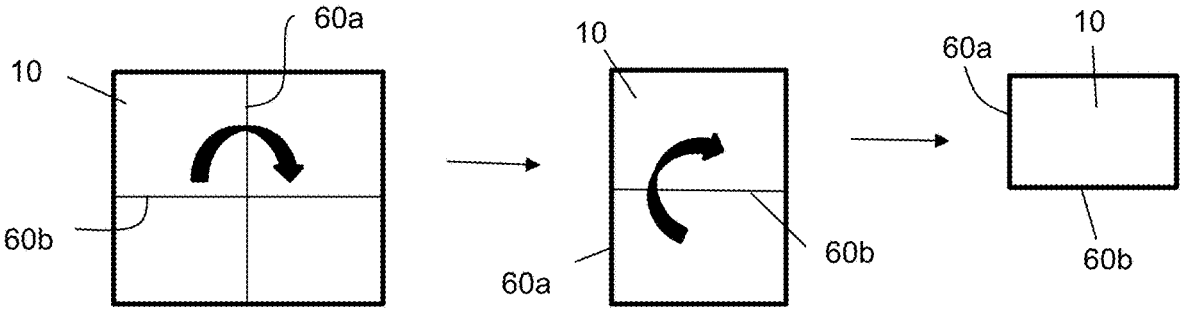

In some embodiments, the playing board can be foldable along central crease 60 or a plurality of creases 60*a* and 60*b* to be easily stored and/or shipped, as illustrated in FIGS. 5*a* and 5*b*. Thus, game board 10 can be folded in half, thirds, quarters, etc.

Figure 6A:
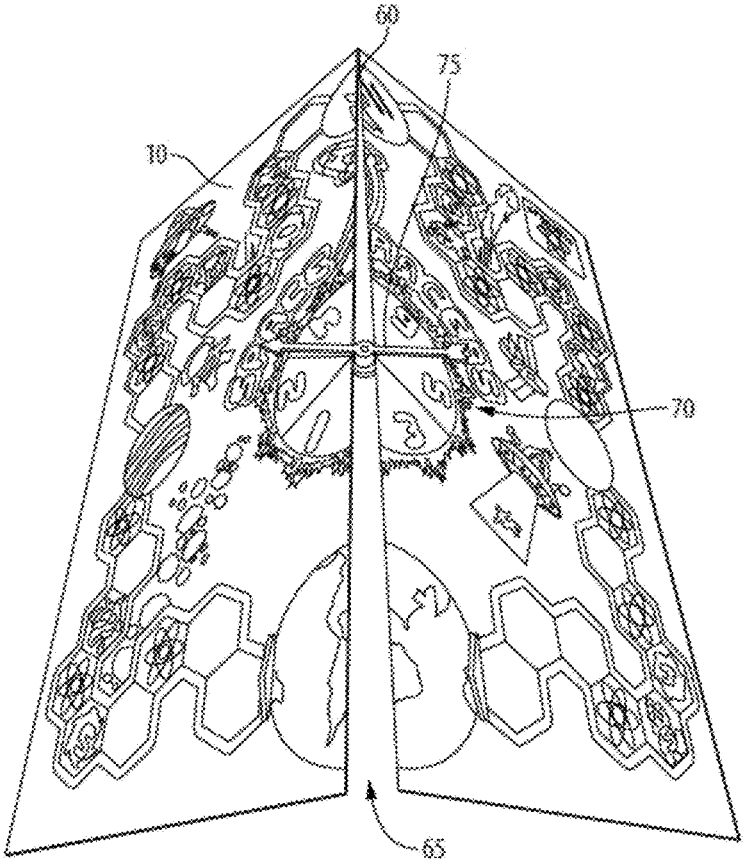
FIG. 6*a* is a perspective view of folding the playing board to insert a spinner in accordance with some embodiments of the presently disclosed subject matter.
Figure 6B:
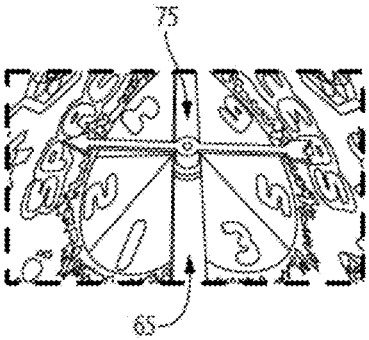
FIG. 6*b* is a fragmentary view of a spinner inserted in a playing board in accordance with some embodiments of the presently disclosed subject matter.

In some embodiments, the playing board can be configured to cooperate with spinner 20 as shown in FIGS. 6*a* and 6*b*. As shown, playing board 10 can include one or more creases 60 and one or more slits 65 that allow spinner 15 to be inserted anywhere along the split, such as the approximate center of the game board. The slit can be positioned along the length or width of the game board in an approximate central location. In some embodiments, top surface 25 is printed or otherwise demarcated with numbers 70 such that the spinner portion only includes an actual moving element 75 (e.g., an arrow that reacts to manipulation by a player to spin around and land on one of the numbers). The moving element can be maintained in place when the playing board is laid flat such that it cannot move. However, any element can be used to retain the moving element in place, such as magnets, clips, and the like.

Figure 6C:
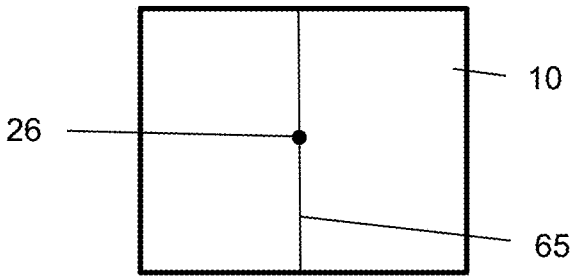
FIG. 6*c* is a top plan view of a playing board comprising a slit and a corresponding hole in accordance with some embodiments of the presently disclosed subject matter.

In some embodiments, the slit can include hole 26 drilled or otherwise positioned through the board within slit 65, as illustrated in FIG. 6*c*. The base of the spinner arrow can be positioned within the hole to anchor the spinner in place. The hole can be positioned anywhere along slit 65 and is not limited to any particular location.

Figure 7A:
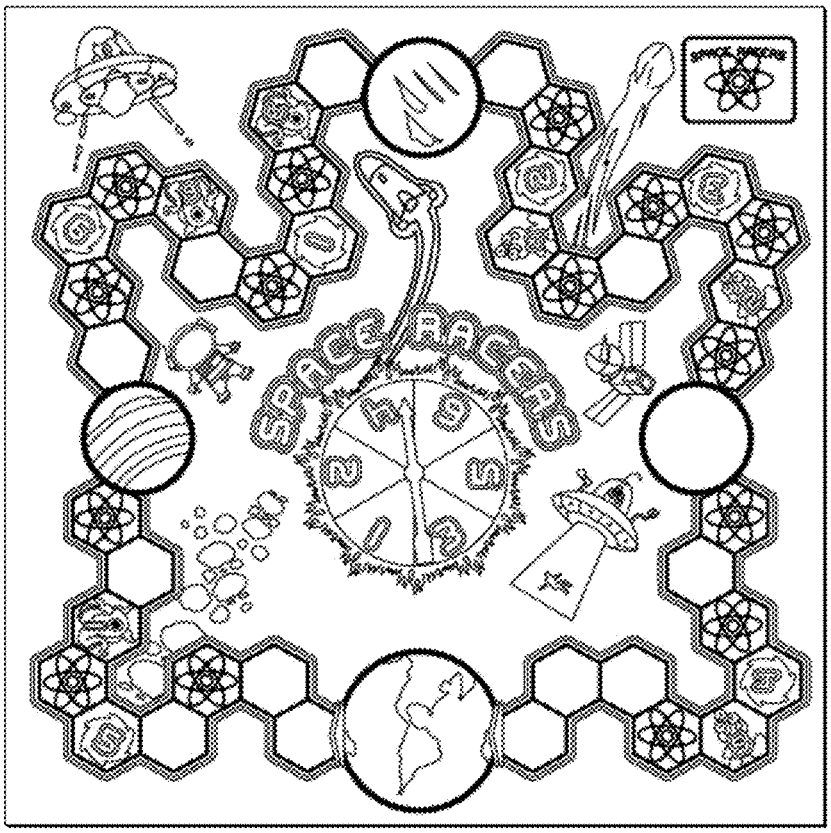
FIGS. 7*a* and 7*b* are top plan views of playing boards in accordance with some embodiments of the presently disclosed subject matter.
Figure 7B:
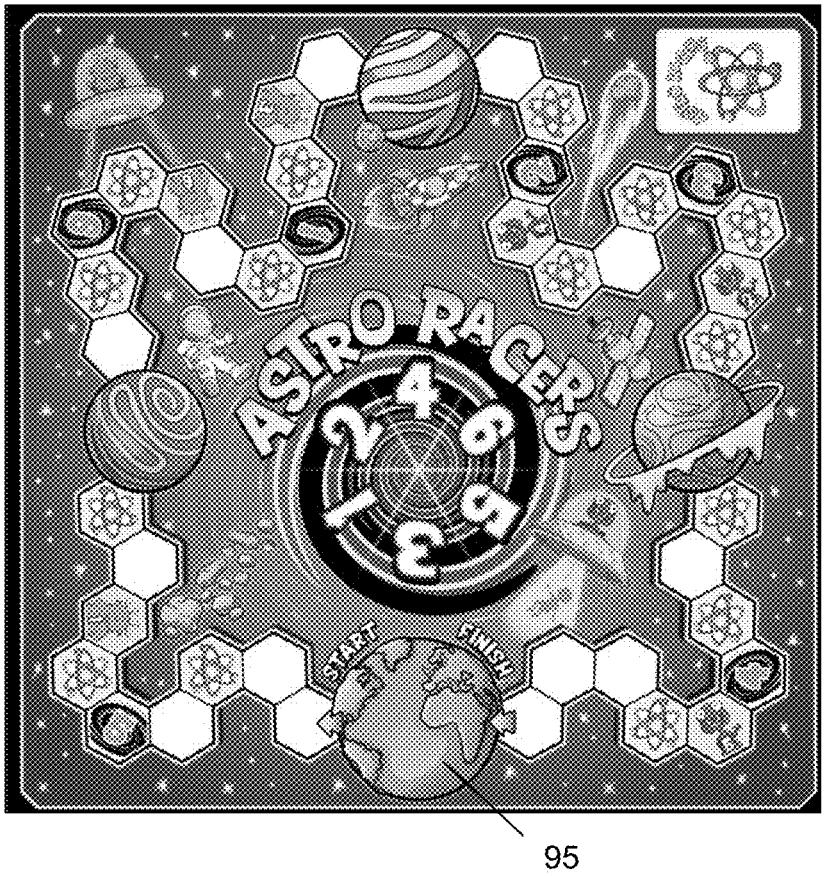
Figure 8:
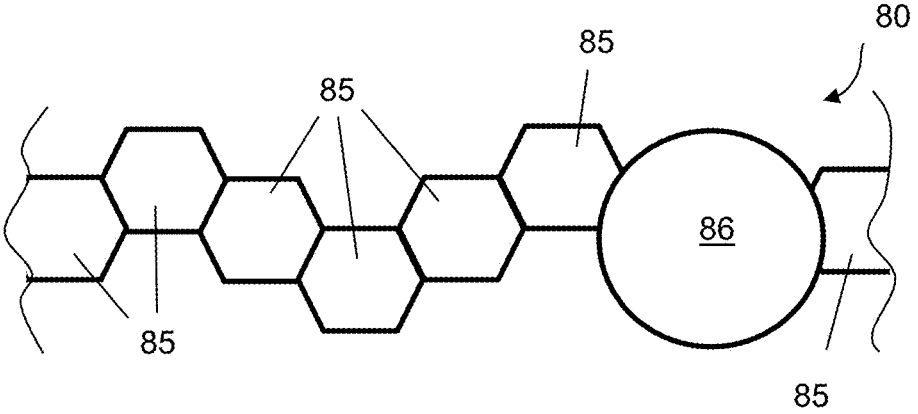
FIG. 8 is a fragmentary top plan view of a game board track in accordance with some embodiments of the presently disclosed subject matter.

Top playing surface 25 of the game board can be marked or printed in any desired way. For example, the top playing surface can include track 80 along which each player's playing pieces must travel from a start to a finish, as illustrated in FIGS. 7*a* and 7*b*. The track includes a series of individual spaces 85 that a player must travel on to reach the end of the track (e.g., Earth), as shown in FIG. 8. In some embodiments, a plurality of spaces 85 can be hexagonal in shape, although any shape can be used. In addition, track 80 can include one or more special spaces 86 that are treated differently from standard spaces 85, as noted in detail below. The special spaces can be shaped and/or sized differently when compared to the standard spaces (e.g., shaped as an enlarged planet).

Figure 9A:
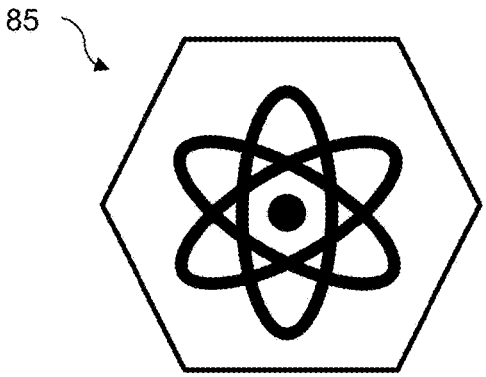
FIGS. 9*a*-9*d* are top plan view of a game track spaces in accordance with some embodiments of the presently disclosed subject matter.
Figure 9B:
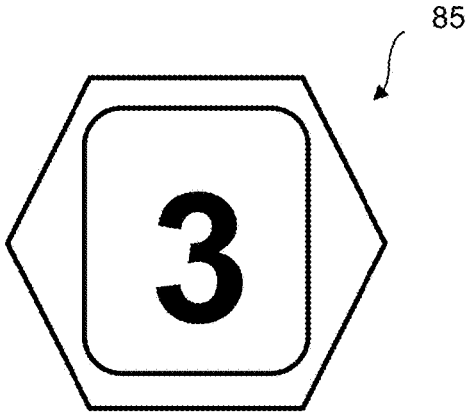
Figure 9C:
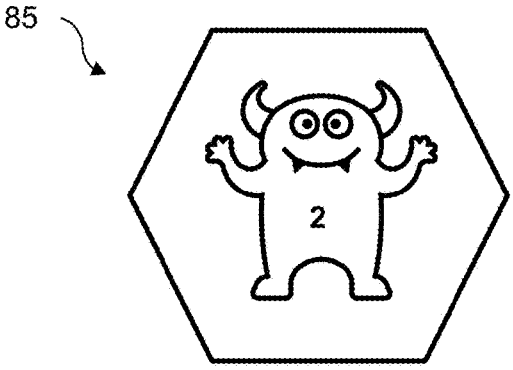
Figure 9D:
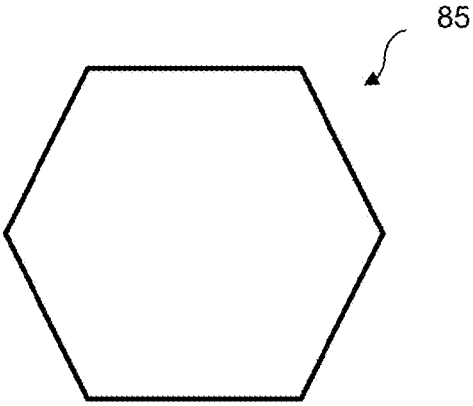

In some embodiments, one or more spaces 85 can include space-themed images, words, and/or numbers, as shown in FIGS. 9*a*-9*c*. Each image can be representative of an action taken by a player that lands on that particular space, as discussed below. One or more spaces can also be blank, as shown in FIG. 9*d*. A blank space indicates that no action (good or bad) is to be taken by a player that lands on that space. It should be appreciated that the images included on a space are not limited and any image can be used.

To set up the game, the board is opened to expose slit 65, and the spinner arrow moving portion 75 is placed in the spinner hole positioned in the middle of the board, as illustrated above in FIG. 6*a*. In this way, the spinner arrow can freely rotate in a circular direction when force is applied, landing on a number printed on the board top surface. Playing board 10 can be placed on a support surface (such as a table) in a flat orientation. A user setting up the board can push down on the board at or near the center to set the spinner into place.

Figure 10A:
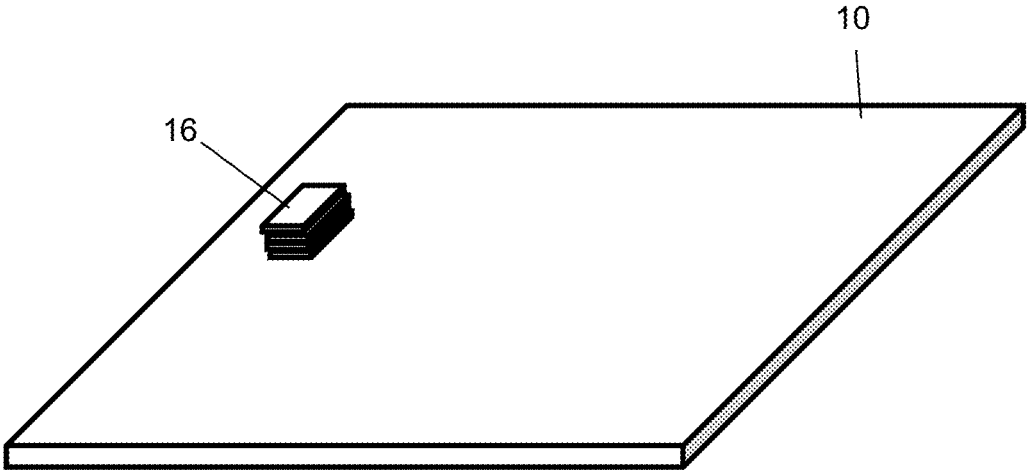
FIG. 10*a* is a perspective view of a playing board in accordance with some embodiments of the presently disclosed subject matter.

After the game board has been set up, a set of cards 16 (e.g., Space Action Cards) are shuffled and placed face down on the board, as shown in FIG. 10*a*. Alternatively, the cards can be placed adjacent to the board (e.g., on a table).

Figure 10B:
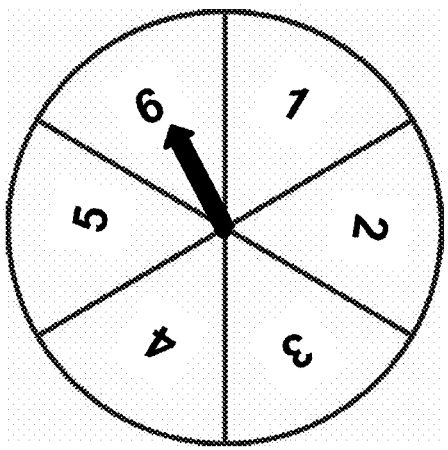
FIG. 10*b* is a top plan view of a spinner in accordance with some embodiments of the presently disclosed subject matter.
Figure 11:
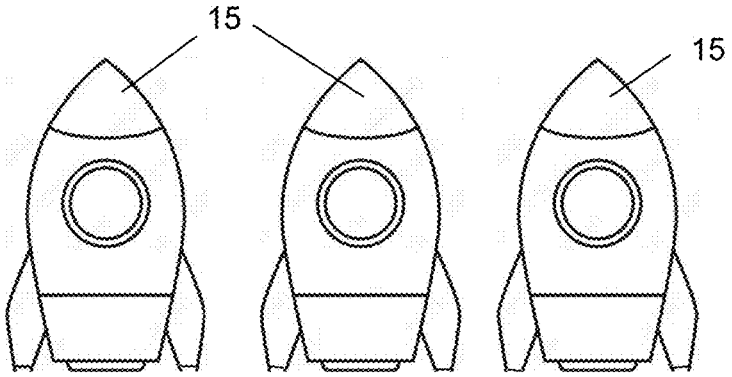
FIG. 11 is a front plan view of a plurality of playing pieces in accordance with some embodiments of the presently disclosed subject matter.

To determine playing order, each player rotates spinner 20, as shown in FIG. 10*b*. Specifically, each player will apply pressure to the spinner, which results in rotation of the arrow about the numbered region of the board. Once the arrow loses momentum, it will rest on a particular number. The player with the highest number picks 2 game pieces 15 of the same color and puts them on starting space 95 (which can be shaped like planet Earth in some embodiments). The game pieces are not limited and can be configured in any desired shape. For example, the game pieces can vary in color, size, and/or shape to distinguish the game piece of player 1 from the game piece of player 2. Each player can select a plurality of game pieces (e.g., 2). One example of representative game pieces are illustrated in FIG. 11. However, it should be noted that game pieces 15 are not limited to any particular shape, size, color, and the like. For example, the game pieces can have a space theme in some embodiments (e.g., rockets, spacemen, etc.). Any shape can be used.

The player that spins the highest number will be deemed Player 1 and will initiate game play. If two players tie for the highest number, those two players will spin again until one player has the higher number and is deemed Player 1. Player 1 will then position their playing pieces on starting space 95 of track 80. In some embodiments, starting space for all players along track 80 is planet Earth. The remaining players (in a clockwise direction from Player 1) then pick 2 playing pieces and position them on starting space 95. Player 1 then initiates game play.

Player 1 rolls two dice 17 to start the turn (one for each playing piece 15). Each player's roll of dice will indicate the number of spaces that a player may advance his or her game piece 15 along track 80. For example, if a player rolls a 1 and a 6, one playing piece must advance 1 space along the track and the other playing piece must advance 6 spaces along the track. Thus, each die is used separately to move each of the player's playing pieces. The player chooses which die will move which playing piece 15. In this way, a player can strategically move their playing pieces to avoid undesirable spaces and/or create a disadvantage for an opponent. After a roll, each playing piece moves the number of spaces shown on the die.

If a player rolls doubles, that player cannot move and must roll again. If a player rolls doubles twice in a row, that player then loses the turn.

Each space 85 is treated as a single number on a die. For example, a player that advances along the track one hexagon space to one planet space to one hexagon space moves 3 total spaces. Further, the starting space is not treated as a space when starting the game.

Players can move playing pieces 15 in any order they choose on a roll of the dice. Thus, a player can move playing piece 1 to correspond to the number rolled in dice 1 and playing piece 2 can be advanced then number of spaces in dice 2 (and vice versa). However, playing piece 1 cannot advance the number of spaces in both the first and second dice. After a player finishes moving all playing pieces that the player has in play, their turn is over and play advances to Player 2. In some embodiments, a "move" refers to all actions related to moving one of the playing pieces (e.g., advancing the playing piece along playing board 10, pulling a card, going through a Worm Hole, and the like). As used herein, the term "turn" refers to the condition wherein a player has completed all actions related to moving all playing pieces that player has in play.

The maximum number of playing pieces allowed on any standard space 85 at a time is equal to the number of players. For example, if there are 4 players, there are 4 maximum playing pieces allowed on a standard space. If there are 2 players, there are 2 maximum playing pieces allowed on a standard space. There is no limit to the number of playing pieces 15 allowed on special spaces 86 (e.g., planets).

Players must move both playing pieces during their turn unless an exclusion applies. For example, if a player cannot move one playing piece using either die because a standard space is fully occupied, then that playing piece forfeits its move, and the remaining playing piece can use either of the 2 dice rolled to move. Further, if a player is unable to move either playing piece 15 because of the exact roll rule or because a standard space is fully occupied, then the player loses their entire turn. However, when a player moves their last playing piece (e.g., that player has only one playing piece left in play), and the playing piece cannot move using the 1 die rolled due to the exact roll rule, or because a standard space is fully occupied, then that player loses a turn.

Each playing piece 15 must return to the start space (e.g., planet Earth) by an exact roll of the die. For example, if there are 5 spaces between a playing piece and the start space, that player must roll a 5 to advance the playing piece to the start space.

Once a player gets one of the playing pieces back home by returning to the start space (e.g. planet Earth), that player will then roll only 1 die for all subsequent turns.

As noted above, some of the standard spaces are marked with an instruction or challenge to a player that lands on that space. For example, if a player lands on a space 85 that is marked with the image of an alien and number (e.g., each alien image includes a number), that player must then immediately spin spinner 20. If the player spins the same number on the alien space, that playing piece moves backward to the closest special space 86 (e.g., planet). If the player spins a different number from the number listed on the alien space, that player takes no additional action and has avoided abduction by the alien.

Some spaces 85 indicate that a player must select a card 16 from the stack (deemed a Space Action space). When a player lands on a Space Action space, that player then selects a card 16 and takes the appropriate action. When all cards are used, the discard pile is shuffled and replayed.

Cards 16 can include a variety of actions. For example, the deck can include one or more METEOR SHOWER cards that require a player to move a playing piece backwards a given number of spaces shown (e.g., 1-4 spaces) and take the appropriate action for the space landed on.

The deck can also include one or more RADAR RELAY cards that require the player to move a playing piece 15 forwards a given number of spaces (e.g., 1-4 spaces) and take the appropriate action for the space landed on.

Cards 16 can include one or more BOOSTER BLAST cards that require a player to spin spinner 20 and move a playing piece the corresponding number of spaces forward, taking appropriate action for the space landed on.

The deck can include one or more TELEPORT cards that allow the player to optionally switch places with any other playing piece on the board if desired (e.g., other player's playing piece)—however a playing piece positioned on a planet (e.g., special space) is immune to switching.

The deck can include a GRAVITATIONAL PULL card that requires a player to move a playing piece to the closest planet (special space), either forwards or backwards.

A WORM HOLE card requires the player to spin spinner 20 and move the playing piece to the corresponding Worm Hole space on the board with the same number.

The cards can include one or more CONSTELLATION cards that allow players to observe the stars and no moves are required.

The deck can include one or more LASER BLAST card that must be kept and used at a later time. Players cannot hold more than one Laser Blast Card at any one time. If a second Laser Blast card is picked up, it must be put in the discard pile. The Laser Blast Card may be used in 1 of 2 ways. With option 1, a player may choose to use (give back) a Laser Blast Card when they pick up a Meteor Shower Card to avoid having to move backwards. With option 2, at the beginning of a player's turn (before they roll), a player may choose to use a Laser Blast Card to move another player's playing piece backwards to the nearest special space (e.g., planet). However, with option 2, the player doing the blasting must be within 2 spaces of the opponent being blasted, either forwards or backward. The Astro Racer doing the blasting loses its move when the Laser Blast Card is used. The player's second playing piece (if still in play) may still be moved by rolling 1 die. A playing piece that is on a special space (planet) cannot be blasted with the Laser Blast Card.

Figure 12A:
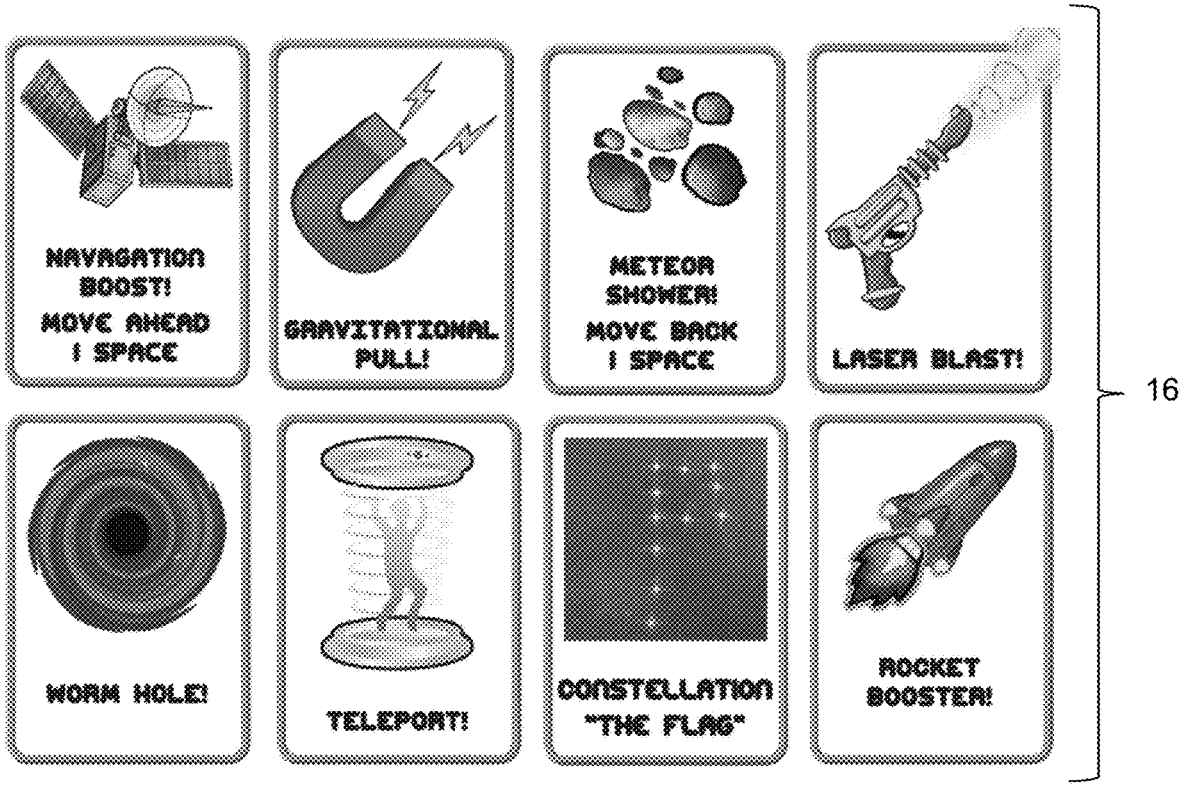
FIGS. 12*a* and 12*b* are top plan views of a plurality of playing cards in accordance with some embodiments of the presently disclosed subject matter.
Figure 12B:
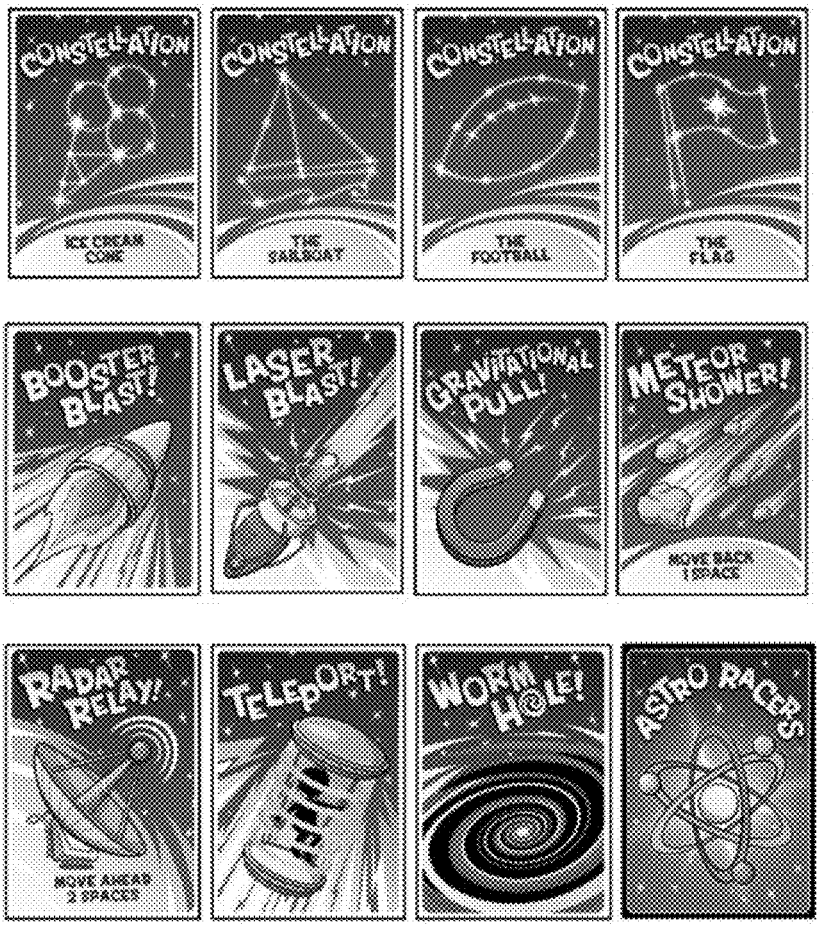

While not limited to any design, representative cards 16 are illustrated in FIGS. 12*a* and 12*b*. However, the size, shape, or graphics associated with the cards is not limited.

The first player to get both of their playing pieces 15 back to the starting space (planet Earth) wins the game.

Although the present invention and its advantages have been described in detail, various changes, substitutions, and alterations can be made herein without departing from the spirit and scope of the invention as defined by the appended claims. Moreover, the scope of the present application is not intended to be limited to the embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of playing a game by two or more players, the method comprising:

providing a game, the game comprising:

a playing board with a top playing surface defined by a single track, each track including a plurality of standard spaces, a plurality of planet spaces, a start and end space, a plurality of alien spaces, and a plurality of card-drawing spaces;

a plurality of game pieces, two of each type;

a spinner;

two dice;

a plurality of cards, each indicating an action for a player in possession of the card, the actions selected from advancing a number of spaces, retreating a number of spaces, switching playing piece location with another player playing piece location, moving a playing piece to a planet space, moving an opponent's playing piece backwards to the nearest planet space;

assigning two of the game pieces to each player;

positioning all game pieces on the start space;

determining playing order of each player;

wherein a first player rolls the dice and advances a first playing piece the number assigned to one die and a second playing piece a number assigned to the second die rolled;

wherein if a player lands on a standard space occupied by a number of playing pieces equal to the number of players, that player loses a move and does not advance to the space occupied by the other playing pieces;

wherein after the first player rolls the dice, moves the playing pieces and takes appropriate action, the first player's turn is over and play moves to the next player; and wherein the player to return both playing pieces to the end space first is determined the winner of the game.

2. The method of claim 1, wherein the playing order is determined by spinning the spinner, such that the player that spins the higher number is the first player to move.

3. The method of claim 1, wherein if a player rolls the same number on both dice, that player must roll again.

4. The method of claim 1, wherein if a player rolls doubles twice in a row, the player loses a turn.

5. The method of claim 1, wherein a player must roll exactly the number of spaces to land in the end space.

6. The method of claim 1, wherein when a playing piece lands on an alien space of the plurality of alien spaces, the player spins the spinner and moves backward to the nearest planet space if the number on the spinner matches a number on the alien space.

7. The method of claim 1, wherein when a player lands on a drawing card space, that player draws a card that directs the player to take an action.

8. The method of claim 7, wherein the action is selected from moving forwards a set number of spaces, moving backwards a set number of spaces, moving to a specific numbered space after using the spinner, switching playing piece location with another player playing piece location, moving a playing piece to the nearest planet space either forwards or backwards, moving an opponent's playing piece backwards to the nearest planet space.

* * * * *